US006655135B2

(12) United States Patent
Oka

(10) Patent No.: US 6,655,135 B2
(45) Date of Patent: Dec. 2, 2003

(54) CONSTRUCTION MACHINE

(75) Inventor: Hidekazu Oka, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 22 days.

(21) Appl. No.: 10/150,934

(22) Filed: May 21, 2002

(65) Prior Publication Data

US 2002/0184881 A1 Dec. 12, 2002

(30) Foreign Application Priority Data

Jun. 11, 2001 (JP) ..... 2001-175241

(51) Int. Cl.[7] ..... F04B 49/00
(52) U.S. Cl. ..... 60/329; 60/449
(58) Field of Search ..... 60/329, 431, 445, 60/449

(56) References Cited

U.S. PATENT DOCUMENTS 5,176,504 A * 1/1993 Moriya et al. ..... 60/428
5,410,878 A * 5/1995 Lee et al. ..... 60/431
5,758,499 A * 6/1998 Sugiyama et al. ..... 60/450

* cited by examiner

*Primary Examiner*—Edward K. Look
*Assistant Examiner*—Thomas E. Lazo
(74) *Attorney, Agent, or Firm*—Oblon, Spivak, McClelland, Maier & Neustadt, P.C.

(57) ABSTRACT

In a construction machine according to the present invention wherein there is made an engine speed sensing control to control a pump horsepower in accordance with an engine speed of an engine, there is performed, in a low temperature condition with hydraulic oil temperature not reaching a preset temperature, a low temperature horsepower control involving setting the pump horsepower lower than at room temperature which is not lower than the preset temperature to lighten a burden on the engine. With this control, it is possible to prevent the occurrence of engine overtorque and hunting at a low temperature.

8 Claims, 4 Drawing Sheets

CONSTRUCTION MACHINE

BACKGROUND OF THE INVENTION

1. Field of the Invention

The present invention relates to a construction machine having a hydraulic pump control system.

2. Description of the Related Art

Generally, for preventing an engine stall in a construction machine, there is performed an engine speed sensing control (hereinafter referred to as "ESS control") in which a pump horsepower (pump discharge) is controlled in accordance with number of revolutions of an engine, i.e., engine speed or engine revolutions.

According to the ESS control, when pump load (pump pressure) increases and the engine speed decreases, pump flow rate is decreased. In this case, a control is made so that the pump horsepower becomes small in reply to a large load and becomes large in reply to a small load, and therefore an engine stall is prevented.

However, the conventional pump control system involves the following problems.

When a construction machine is operated at a low temperature, for example in the winter season, the temperature of the hydraulic oil and that of the engine oil are low and highly viscous just after start-up of the engine. Under the resistance of these oils, the engine torque increases.

If in this state there is performed a work of a large load, for example if there is performed an arm pushing operation for an arm as an excavating attachment in a hydraulic excavator, there is conducted a pump horsepower control based on only engine speed by ESS control as is the case with the control at room temperature despite the engine load being large under the aforesaid oil resistance. As a result, the engine torque becomes overtorque, causing a great damage to the engine.

If the viscosity of the hydraulic oil is high, the reaction of a pump regulator which is operated with the hydraulic oil becomes dull and the response of the pump to a discharge rate command is delayed. Consequently, in a work under a greatly varying load, hunting is apt to occur in the pump discharge rate command→pump discharge rate ESS control system.

SUMMARY OF THE INVENTION

It is an object of the present invention to provide a construction machine having a pump control system which can prevent the occurrence of engine overtorque and hunting at low temperatures.

The construction machine of the present invention comprises an engine; a hydraulic pump which is actuated by the engine; a hydraulic actuator circuit adapted to use the hydraulic pump as a hydraulic oil source; a pump regulator adapted to control discharge rate of hydraulic oil or working oil discharged from the hydraulic pump; an engine speed detecting means such as an engine speed sensor adapted to detect the number of revolutions of the engine; a temperature detector adapted to detect temperature of the hydraulic oil; and a control means adapted to control the discharge rate of the hydraulic pump through the pump regulator. The control means is constructed so as to perform an engine speed sensing control in which the pump flow rate is controlled in accordance with engine speed or engine revolutions. The control means is further constructed so as to perform a low-temperature horsepower control such that in a temperature region wherein the temperature of the hydraulic oil is lower than a preset temperature the pump flow rate relative to the engine speed is decreased to a lower level than when the temperature of the hydraulic oil is not lower than the preset temperature.

In this connection, when the temperature of the hydraulic oil does not reach the preset temperature (at a lower temperature than the preset temperature), it is possible to perform a low-temperature horsepower control in which the pump horsepower is set lower than when then the temperature is not lower than the preset temperature (at room temperature). With this control, the engine load is diminished, so that it is possible to prevent overtorque of the engine at a low temperature.

Moreover, according to the low-temperature horsepower control, the absolute value of the pump flow rate is low and the amount of change in the pump flow rate caused by a load variation becomes small, so that hunting is difficult to occur.

The temperature of engine oil also contributes to overtorque. However, as the temperature of the hydraulic oil rises, the temperature of the engine oil also rises, so that temperature of the engine oil can be detected indirectly by detecting the temperature of the hydraulic oil. Therefore, even without separately detecting the temperature of the engine oil, the desired object can be achieved by detecting the temperature of hydraulic oil and controlling the horsepower in the manner mentioned above.

Alternatively, the temperature of the hydraulic oil may be detected indirectly by detecting the temperature of the engine oil. Further, since the temperature of engine cooling water is correlated with the temperature of the hydraulic oil, the temperature of the hydraulic oil may be detected indirectly by detecting the temperature of the engine cooling water.

DESCRIPTION OF THE PREFERRED EMBODIMENTS

Figure 1:
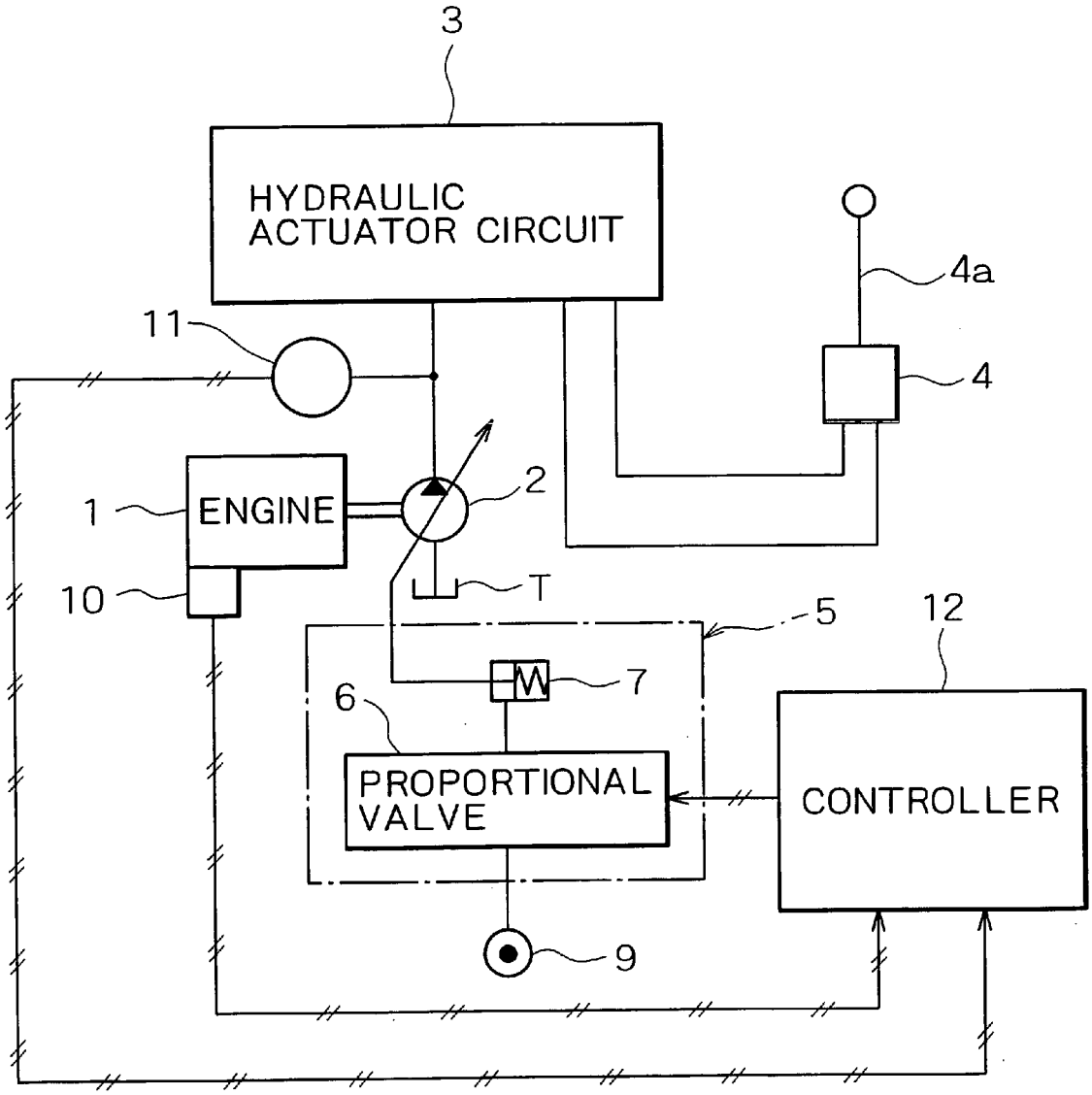
FIG. 1 is a block diagram of a pump control system according to a first embodiment of the present invention.

Each pump control system embodying the present invention will be described hereinunder with reference to FIGS. 1 to 5. It is to be understood that the invention is not limited thereto.

In the following embodiments the same portions will be identified by the same reference numerals and overlapped explanations thereof will be omitted; only different points will be described.

Figure 2:
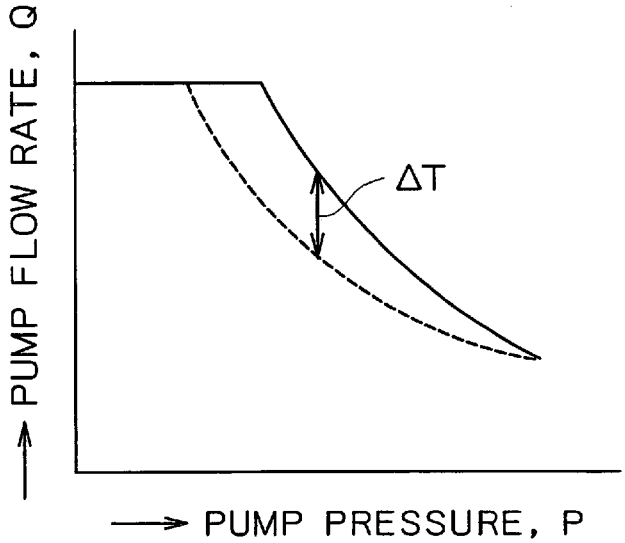
FIG. 2 is a horsepower characteristic diagram showing the results of control made by the control system.
Figure 3:
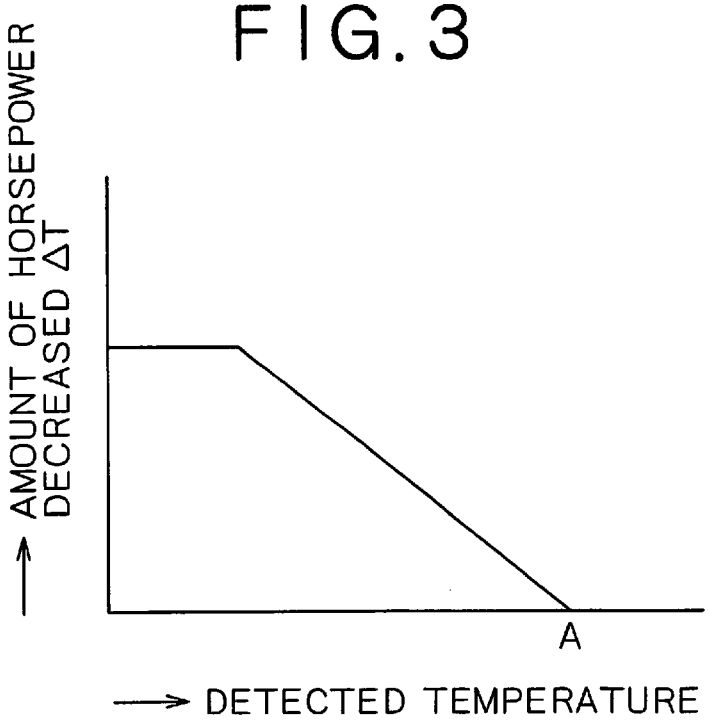
FIG. 3 is a diagram showing a relation between a horsepower decreasing control made by the control system and detected temperatures.

First Embodiment (FIGS. 1 to 3)

In FIG. 1, the numeral 1 denotes an engine and numeral 2 denotes a variable displacement type hydraulic pump which is driven by the engine 1. A hydraulic actuator circuit 3 provided with a hydraulic actuator (not shown) such as a hydraulic cylinder or a hydraulic motor is driven with hydraulic oil discharged from the pump 2.

For example in the case of a hydraulic excavator, as the hydraulic actuator circuit 3 there are provided a travel motor circuit for driving a lower travel body, a rotating motor circuit for rotating an upper rotating body, and each cylinder circuit for actuating boom, arm, and bucket, respectively, as excavating attachments.

Numeral 4 denotes an operating means for operating the hydraulic actuator circuit 3. The operating means 4 is operated with a lever 4*a*. A pilot pressure proportional to operated amount of the lever 4*a* is applied to a hydraulic pilot type control valve (not shown) provided in the hydraulic actuator circuit 3 to actuate the control valve, whereby supply or discharge of oil from the pump 2 is controlled.

The operating means 4 is provided in a plural number correspondingly to plural actuator operations although only one operating means is illustrated for the simplification of illustration.

Numeral 5 denotes a pump regulator which is provided with an electromagnetic proportional valve 6 and a tilt driving unit 7. The proportional valve 6 operates in accordance with a command signal provided from a controller 12. With a secondary pressure of the proportional valve 6, the tilt driving unit 7 operates to control the tilting of the pump, whereby the pump discharge rate hereinafter referred to as pump flow rate is controlled. Numeral 9 denotes a hydraulic oil source for the pump regulator 5 and the reference mark T denotes a tank.

According to an ESS control, when the pump load (pump pressure) increases and the engine speed decreases, a command signal for decreasing the pump flow rate is provided from the controller 12 to the pump regulator 5 in accordance with a signal provided from an engine speed sensor 10 as detector adapted to detect the number of revolutions of the engine. With this command signal, a control is made so that an absorption torque (horsepower) of the pump 2 is small at a high load and is large at a low load. Consequently, the absorption torque and the engine horsepower are well-balanced and the occurrence of engine stall is prevented.

Numeral 11 denotes a temperature sensor adapted to detect the temperature of hydraulic oil discharged from the pump 2. A signal of the temperature of the hydraulic oil detected by the sensor 11 is provided to the controller 12.

In this case, since the temperature of the hydraulic oil is detected directly, accurate detection can be done without being affected by a change in outside air temperature, as compared with an indirect detection. Therefore, a more accurate pump control can be effected while keeping a switching temperature of the control constant.

Although in FIG. 1 the hydraulic oil temperature in a pump discharge line is detected by the sensor 11, there may be detected a hydraulic oil temperature in the circuit 3 or in the tank T.

When the detected hydraulic oil temperature is not lower than a preset temperature (a temperature at which there is no fear of engine overtorque or hunting), the controller 12 makes the following control. The controller 12 controls the pump flow rate through the pump regulator 5 by ESS control so as to afford such a pump horsepower characteristic at room temperature as indicated with a solid line in FIG. 2. This ESS control at room temperature will hereinafter be referred to as "room temperature horsepower control."

On the other hand, when the hydraulic oil temperature does not reach the preset temperature(or being lower than the preset temperature), the controller 12 makes the following control. The controller 12 controls the pump flow rate by a horsepower decreasing control (low-temperature horsepower control) so as to afford a horsepower characteristic such that absorption horsepower of the pump 2 becomes smaller by a certain value ΔT than in the room temperature horsepower control relative to the engine speed, as indicated with a broken line in FIG. 2.

According to such pump controls, at a low temperature at which the hydraulic oil temperature is low and a rotational resistance of the engine 1 is high, the burden on the engine 1 can be decreased than at room temperature. Consequently, it is possible to prevent overtorque of the engine 1.

In the low-temperature horsepower control, moreover, hunting is difficult to occur because the absolute value of the pump flow rate is low and the amount of a change in the flow rate is small.

The amount of horsepower decreased, ΔT, is set so as to become smaller as the detected temperature rises and approaches a preset temperature A, as shown in FIG. 3. When the detected temperature reaches the preset temperature A, a switching is made to the room temperature horsepower control.

Thus, since the amount of horsepower decreased, ΔT, decreases gradually in accordance with a rise of the hydraulic oil temperature and a switching is made naturally to the room temperature horsepower control, there is no fear of a sudden increase of the flow rate at the switching point of control and hence a shock is not likely to occur at all.

In short, this control makes the degree of decrease in the pump flow rate smaller with a rise of the hydraulic oil temperature. In this case, the degree of decrease in the flow rate becomes smaller and approaches that in the room temperature horsepower control as the hydraulic oil temperature rises, so that there is no fear of a sudden increase of the flow rate to induce a shock at the switching point of control.

Figure 4:
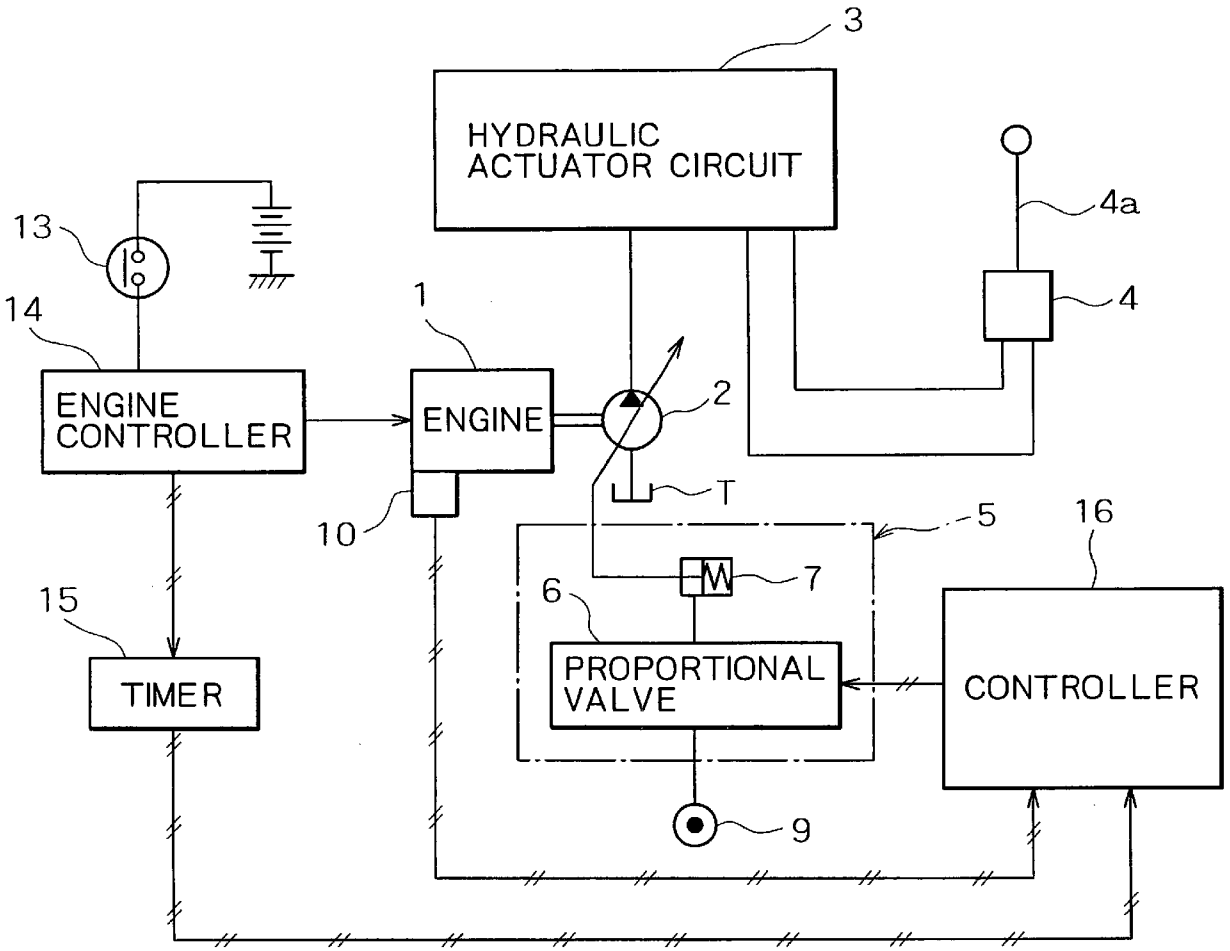
FIG. 4 is a block diagram of a pump control system according to a second embodiment of the present invention.

Second Embodiment (see FIG. 4)

In FIG. 4, the numeral 13 denotes a starting switch adapted to start the engine 1. Upon turning ON of the starting switch 13, the engine 1 starts operating in accordance with a signal provided from an engine controller 14.

In this embodiment, an elapsed time after turning ON of the switch 13 (an elapsed time after start-up of the engine 1) is measured with a timer 15. Until the elapsed time reaches a preset time, an unexpiration signal is fed from the timer 15 to a controller 16. The unexpiration signal indicates that the elapsed time does not reach the preset time yet.

The elapsed time after start-up of the engine is set as the time elapsed until the hydraulic oil temperature reaches the preset temperature, which time can be determined easily by an operation test or the like although it varies depending on the outside air temperature). Upon receipt of the unexpiration signal, the controller 16 performs the low temperature horsepower control.

When the elapsed time reaches the preset time, an expiration signal is fed from the timer 15 to the controller 16 and a switching is made to the room temperature horsepower control.

Just after stop of the engine 1, the hydraulic oil temperature is high. Therefore, it is desirable to construct the control system so that the room temperature horsepower control continues if the engine is re-started within a certain time after turning OFF of the engine. By so doing, there is no fear of the working efficiency being deteriorated by a wasteful horsepower decreasing control.

In this embodiment, as a temperature sensor there is used an after-engine-start timer (a first timer) adapted to measure an elapsed time after start-up of the engine to detect the temperature of the hydraulic oil indirectly.

Figure 5:
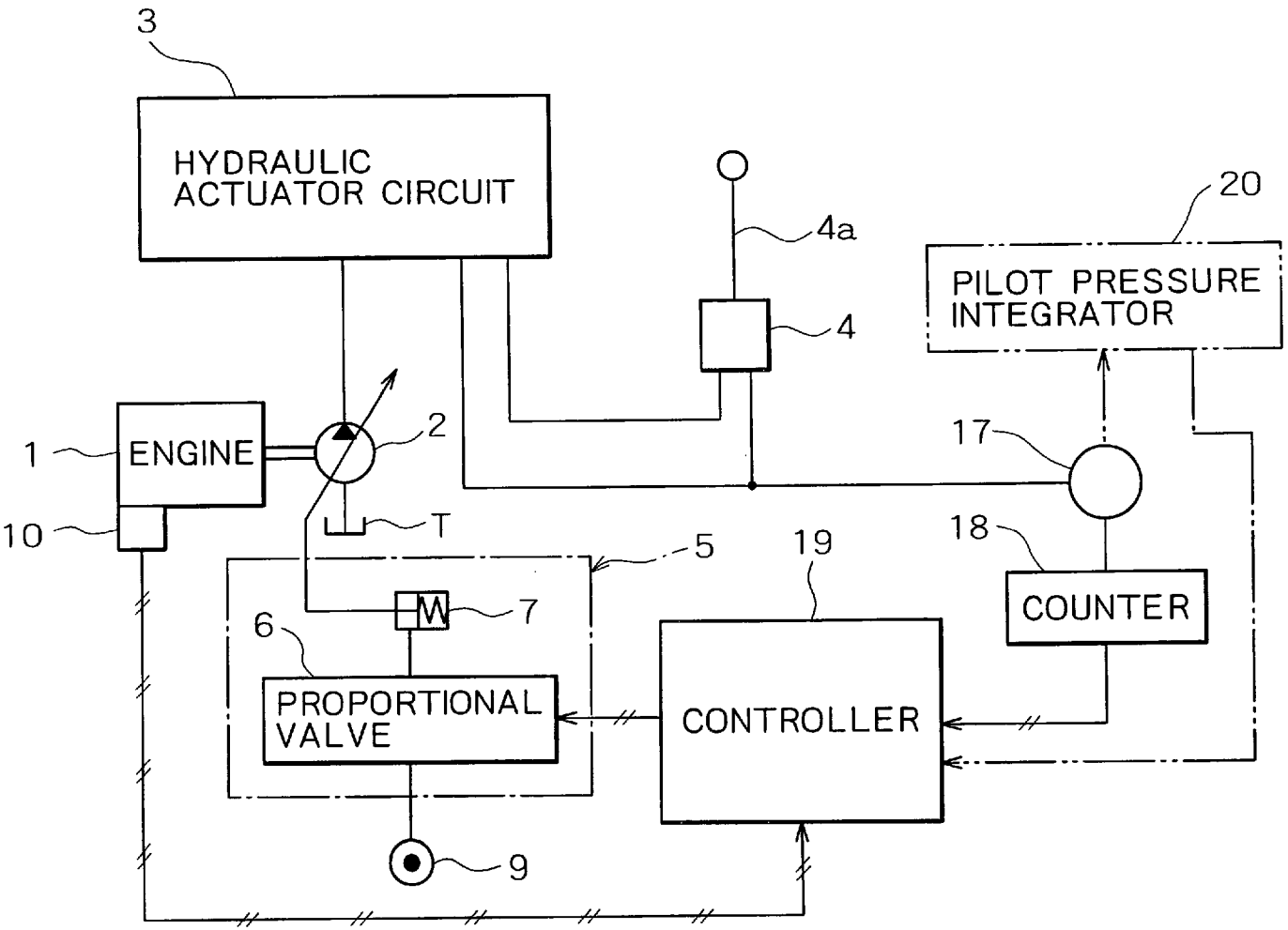
FIG. 5 is a block diagram of a pump control system according to a third embodiment of the present invention.

Third Embodiment (see FIG. 5)

A third embodiment of the present invention shows another example of detecting the temperature of the hydraulic oil indirectly. A pilot pressure developed upon operation of the operating means 4 is detected by a pressure sensor 17 and the number of the detections, i.e., the number of the operations, is counted by a counter (operation counter) 18. The count value thus obtained is inputted to a controller 19. This third embodiment is constructed in such a manner that when the number of operations performed until the hydraulic oil temperature rises to the preset temperature reaches a preset number of operations, the control made by the controller 19 switches from the low temperature horsepower control to the room temperature horsepower control.

In this embodiment there is provided a first operation counter as a temperature sensor adapted to count the number of operations of a hydraulic actuator to detect the hydraulic oil temperature indirectly.

According to the constructions of the second and third embodiments, it is not necessary to use a temperature sensor and the temperature can be detected through signal processings performed in the timer 15 and the counter 18. Consequently, it is possible to reduce the equipment cost.

As indicated with a dash-double dot line in FIG. 5, an integrated value of pilot pressure is determined by a pilot pressure integrator (operation counting means) 20 and is inputted to the controller 19. A construction may be made such that when this integrated value, i.e., a total operation time, has reached a preset time, a switching is made from the low temperature horsepower control to the room temperature horsepower control.

Alternatively, the switching to the room temperature horsepower control may be made when it is detected by either some of such indirect detectors as temperature detectors or a combination of an indirect detector and the direct sensor used in the first embodiment that the hydraulic oil temperature has reached the preset temperature.

By so doing, even in the event one detector should be at fault, an accurate pump control is ensured by the other detector or sensor.

On the other hand, in the third embodiment shown in FIG. 5, a construction may be made such that a greatly load varying operation (e.g., arm pushing operation) which is apt to cause overtorque of the engine 1 or hunting is selected as an actuator operation of the operating means 4 associated with the detection and the low temperature horsepower control is performed only when the actuator operation is conducted at a low temperature.

By so doing, there is no fear that the low temperature horsepower control may be conducted wastefully in a such a light work as is not likely to cause overtorque or hunting, which wasteful control would cause a lowering of the working efficiency.

Such a pump control limited to the specific actuator operation is applicable not only to the construction of the third embodiment but also to the constructions of the first and second embodiments, provided means for detecting the specific actuator operation is added.

As the temperature detector there may be used a second operation counter adapted to measure the operation time of a hydraulic actuator to detect the temperature of the hydraulic oil indirectly.

As detectors which detect the hydraulic oil temperature indirectly there are a detector adapted to detect the hydraulic oil temperature indirectly on the basis of an elapsed time after start-up of the engine, a detector adapted to count the number of operations of a hydraulic actuator, and a detector adapted to detect an operated time of a hydraulic actuator. With these detectors, it is not necessary to use a temperature sensor adapted to detect the hydraulic oil temperature directly and the hydraulic oil temperature can be detected by a signal processing performed by a timer or an operation counter.

Of course, both indirect detector and direct sensor may be combined, or plural indirect detectors may be combined, whereby even in the event of failure of one detector, an accurate pump control is ensured by the other detector or sensor.

As a temperature detector there may be used one provided with an after-engine-stop timer (a second timer) adapted to measure an elapsed time after stop of the engine to detect the hydraulic oil temperature indirectly.

In this case, even after turning OFF of the engine, the hydraulic oil temperature is high just after the engine stop and the room temperature horsepower control is performed. Thus, there is no fear that the working efficiency may be deteriorated by a wasteful horsepower decreasing control.

The control means may be constructed such that the low temperature horsepower control is performed only when a preselected actuator operation is conducted out of plural actuator operations.

In this case, since the low temperature horsepower control is made only when the preselected actuator operation is performed, if there is selected as an actuator operation a greatly load varying operation (e.g., arm pushing operation) which is apt to cause engine overtoque or hunting, there no fear of occurrence of such an inconvenience as a wasteful low temperature horsepower control to lower the working efficiency.

Although an embodiment of the present invention has been described above, the scope of protection of the present invention is not limited thereto.

I claim:

1. A construction machine comprising:

an engine;

a hydraulic pump actuated by said engine;

a hydraulic actuator circuit adapted to use said hydraulic pump as a hydraulic oil source;

a pump regulator adapted to control discharge rate of hydraulic oil discharged from said hydraulic pump;

an engine speed sensor adapted to detect the number of revolutions of said engine;

a temperature detector adapted to detect temperature of the hydraulic oil; and a controller adapted to control the discharge rate of said hydraulic pump through said pump regulator, said controller controlling flow rate of said hydraulic pump in accordance with the number of revolutions of said engine, and in a temperature region where the temperature of the hydraulic oil is lower than a preset temperature, said controller controlling so that the flow rate of the hydraulic pump relative to the number of revolutions becomes smaller than in a case where the temperature of the hydraulic oil is not lower than said preset temperature.

2. The construction machine according to claim 1, wherein said controller makes control to set a degree of decrease in the flow rate of the hydraulic pump small in accordance with a rise in temperature of the hydraulic oil.

3. The construction machine according to claim 1, wherein said temperature detector is a temperature sensor adapted to detect the temperature of the hydraulic oil directly.

4. The construction machine according to claim 1, wherein said temperature detector is a first timer adapted to measure an elapsed time after start-up of said engine to detect the temperature of the hydraulic oil indirectly.

5. The construction machine according to claim 1, wherein said temperature detector is a first operation counter adapted to count the number of operations of a hydraulic actuator to detect the temperature of the hydraulic oil indirectly.

6. The construction machine according to claim 1, wherein said temperature detector is a second timer adapted to measure an operation time of a hydraulic actuator to detect the temperature of the hydraulic oil indirectly.

7. The construction machine according to claim 1, wherein said temperature detector is a second timer adapted to measure an elapsed time after stop of said engine to detect the temperature of the hydraulic oil indirectly.

8. The construction machine according to claim 1, wherein said controller operates only when a preselected actuator operation is performed out of plural actuator operations.

* * * * *